US007739112B2

(12) United States Patent
Sato et al.

(10) Patent No.: US 7,739,112 B2
(45) Date of Patent: Jun. 15, 2010

(54) SIGNAL COUPLING METHOD AND APPARATUS

(75) Inventors: Yasushi Sato, Nagareyama (JP); Davin Patrick, Souraku-gun (JP)

(73) Assignees: Kabushiki Kaisha Kenwood, Tokyo (JP); Advanced Telecommunications Research Institute International, Kyoto (JP)

( * ) Notice: Subject to any disclaimer, the term of this patent is extended or adjusted under 35 U.S.C. 154(b) by 1054 days.

(21) Appl. No.: 10/362,870

(22) PCT Filed: Jun. 27, 2002

(86) PCT No.: PCT/JP02/06479

§ 371 (c)(1),
(2), (4) Date: Feb. 27, 2003

(87) PCT Pub. No.: WO03/005342

PCT Pub. Date: Jan. 16, 2003

(65) Prior Publication Data

US 2004/0015359 A1 Jan. 22, 2004

(30) Foreign Application Priority Data

Jul. 2, 2001 (JP) ..... 2001-201408

(51) Int. Cl.
*G10L 13/00* (2006.01)
*G10L 11/00* (2006.01)

(52) U.S. Cl. ..... 704/258; 704/278

(58) Field of Classification Search ..... 704/265, 704/267, 268, 278

See application file for complete search history.

(56) References Cited

U.S. PATENT DOCUMENTS 3,753,159 A * 8/1973 Burwen ..... 333/17.1

(Continued)

FOREIGN PATENT DOCUMENTS

EP 0 813 184 12/1997

(Continued)

OTHER PUBLICATIONS

Oppenheim at al, Discrete-TimeSignal Processing, Prentice-Hall, Inc., Upper Saddle River, New Jersey 1999, pp. 439-442.*

(Continued)

*Primary Examiner*—David R Hudspeth
*Assistant Examiner*—Samuel G Neway
(74) *Attorney, Agent, or Firm*—Eric J. Robinson; Robinson Intellectual Property Law Office, P.C.

(57) ABSTRACT

A signal connecting method and apparatus is provided which can reduce noises and create natural synthesized voices. The signal connecting method (or apparatus) for connecting a plurality of waveform signals and creating a synthesized waveform signal, has: a step (or unit) for determining an upper limit frequency of a frequency spectrum of each of the plurality of waveform signals; and a step (or unit) for filtering at least a connection portion of each waveform signal by using predetermined filter characteristics having the determined upper limit frequency. The cut-off frequency of the filtering is the higher upper limit frequency in upper limit frequencies of spectra of adjacent two waveform signals before and after the connection portion of the waveform signals. Higher harmonics to be caused by discontinuity of the connection portion of waveform signals can be effectively removed and noises of synthesized waveform signals can be reduced considerably.

2 Claims, 5 Drawing Sheets

U.S. PATENT DOCUMENTS

| | | | | |
|---|---|---|---|---|
| 5,220,629 | A * | 6/1993 | Kosaka et al. | 704/260 |
| 5,377,277 | A * | 12/1994 | Bisping | 381/94.3 |
| 5,463,715 | A * | 10/1995 | Gagnon | 704/267 |
| 5,878,388 | A * | 3/1999 | Nishiguchi et al. | 704/214 |
| 5,890,118 | A * | 3/1999 | Kagoshima et al. | 704/265 |
| 6,021,388 | A * | 2/2000 | Otsuka et al. | 704/268 |
| 6,240,384 | B1 * | 5/2001 | Kagoshima et al. | 704/220 |
| 7,047,194 | B1 * | 5/2006 | Buskies | 704/258 |
| 2002/0032563 | A1 * | 3/2002 | Kamai et al. | 704/207 |

FOREIGN PATENT DOCUMENTS

| | | |
|---|---|---|
| JP | 62-139599 | 6/1987 |
| JP | 05-273998 | 10/1993 |
| JP | 07-072897 | 3/1995 |
| JP | 08-335095 | 12/1996 |
| JP | 10-207455 | 8/1998 |
| JP | 11-352996 | 12/1999 |
| JP | 2000-172285 | 6/2000 |
| JP | 2000-310994 | 11/2000 |

OTHER PUBLICATIONS

Jurafsky et al, Speech and Language Processing, 2000 Pearson Education, Inc., p. 263 and 274.*

Supplementary European Search Report dated Sep. 14, 2005 for Application No. 02738817.2.

International Search Report dated Oct. 8, 2002.

Notification of Refusal Reason, JP 2001-201408, Japanese Patent Office, Jun. 7, 2004.

* cited by examiner

SIGNAL COUPLING METHOD AND APPARATUS

BACKGROUND OF THE INVENTION

1. Field of the Invention

The present invention relates to a signal connecting method and apparatus for connecting waveform signals to create a synthesized waveform signal, and more particularly to a method and apparatus suitable for connecting a plurality of voice waveform signals.

2. Description of the Related Art

Voices synthesized by voice synthesizing technology are used widely nowadays. For example, voice synthesizing technology is used in various situations such as text reading software, telephone number guide, stock guide, traveller's guide, shop guide, and traffic information.

Voice synthesizing methods are classified mainly into a rule synthesizing method and a form editing method.

The rule synthesizing method performs morpheme analysis of a text from which voices are synthesized, and in accordance with the analysis results, performs a phonological process for the text to create voices. This rule synthesizing method has less constraints of the contents of a text from which voices are synthesized and can be used for voice synthesis of texts having a variety of contents. However, with the rule synthesizing method, the quality of output voices is inferior to that of the form editing method.

The form editing method records voices actually spoken by a person and coupling constituent elements obtained by dividing the recorded voices to create target voices. The form editing method is superior to the rule synthesizing method in terms of the voice quality. However, with this form editing method, it is not possible to synthesize voices which contain constituent elements unable to be derived from the recorded voices. Therefore, the larger the division unit of recorded voices, the more the constrains of voices to be synthesized. In this connection, a method capable of synthesizing voices of various types has been proposed by using the form editing method by finely dividing recorded voices to the level of vowel and consonant.

However, the waveform at the connection portion of constituent elements of recorded voices becomes discontinuous as shown in FIG. 6(*a*), resulting in the generation source of noises. If the division unit of recorded voices is small, noises become conspicuous because the connection portions are discontinuous and the quality of synthesized voices is lowered.

As one method of reducing such noises, it is considered, for example, to replace a discontinuous portion with a straight line as shown in FIG. 6(*b*) to reduce noises. However, this connection portion creates higher harmonics, also resulting in noises.

Another approach to reduce noises to be caused by discontinuous connection portions is a Minimum Distance Search (MDS) method. With this method, as shown in FIG. 6(*c*) when two waveforms are connected, a point having generally the same instantaneous value and tangent gradient is searched from a portion as near to the trailing edge of the forward waveform as possible and from a portion as near to the leading edge of the backward waveform, and these two points are connected together.

With the MDS method, however, the connection point of the two waveforms is generally a point different from the edge of each waveform. Parts of the waveforms to be connected are usually discarded so that synthesized waveforms become unnatural.

SUMMARY OF THE INVENTION

The present invention has been made taking into in consideration the above-described circumstances and aims to provide a signal connecting method and apparatus capable of creating natural synthesized voices having smaller noises.

In order to achieve the above object, a signal connecting method of the invention comprises essentially, in order to inter connect a plurality of waveform signals and create a synthesized waveform signal, steps of: inter connecting the plurality of waveform signals in a predetermined order; and filtering the plurality of connected waveform signals during a predetermined time period including each connection time period of the plurality of connected signals. The predetermined time period is preferably one tenth or shorter of a time duration of each waveform signal. According to another aspect of the invention, the signal connecting method comprises steps of: inter connecting the plurality of waveform signals together in a predetermined order; determining an upper limit frequency of a frequency spectrum of each of the plurality of waveform signals; and filtering at least a connection portion of each waveform signal by using predetermined filter characteristics having the determined upper limit frequency. The filtering step is performed by using low-pass filters and the predetermined filter characteristics include a cut-off frequency of each low-pass filter. A higher upper limit frequency in upper limit frequencies of spectra of two waveform signals before and after the connection portion is determined as the cut-off frequency of the low-pass filter. An upper limit frequency of a frequency spectrum of each waveform signal is obtained through spectral analysis by Fourier transform. The upper limit frequency of a frequency spectrum of each waveform signal may be obtained in accordance with an average amplitude level of a signal obtained by high-pass filtering the connected waveform signals.

This invention is structured as described above. Accordingly, higher harmonics to be caused by the discontinuity of connection portions of waveform signals can be removed efficiently by the filters having the filter characteristics matching the spectra of waveform signals before and after the connection portion of waveform signals. Noises of the synthesized waveform signal can be reduced considerably.

According to a further aspect of the invention, a signal connecting method of the invention comprises steps of: creating a synthesized waveform signal by inter connecting a plurality of input waveform signals; determining a filtering bandwidth in accordance with upper limit frequencies of spectra of a pair of adjacent waveform signals in the synthesized waveform signal; and filtering a connection portion of the pair of waveform signals of the synthesized waveform signal by using the determined filtering bandwidth. The connection portion of the pair of waveform signals connected by the signal connection method is filtered by the bandwidth determined from the spectrum of high frequency components of an input waveform signal. It is therefore possible to remove noises to be caused by higher harmonics components from the synthesized waveform signal. With the signal connecting method, the end portion of an input waveform signal is not cut so that natural synthesized voices can be reproduced from an input waveform signal of voice waveforms.

Similar to the signal connecting method, a signal connecting apparatus of the invention comprises essentially: in order to connect a plurality of waveform signals and create a synthesized waveform signal, comprising: means for inter connecting the plurality of waveform signals in a predetermined order; and filters for filtering the plurality of connected waveform signals during a predetermined time period including each connection time period of the plurality of connected signals. According to another aspect, the signal connecting apparatus comprises: means for connecting the plurality of waveform signals together in a predetermined order; means for determining an upper limit frequency of a frequency spectrum of each of the plurality of waveform signals; and filters for filtering at least a connection portion of each waveform signal by using predetermined filter characteristics having the determined upper limit frequency. The filters are low-pass filters and the predetermined filter characteristics include cut-off frequencies of the low-pass filters. The higher upper limit frequency in upper limit frequencies of spectra of two waveform signals before and after the connection portion is determined as the cut-off frequency of each low-pass filter. The upper limit frequency determining means includes spectrum analyzers for performing Fourier transform, or high-pass filters.

According to another aspect, the signal connecting apparatus of the invention comprises: connecting means for creating a synthesized waveform signal by inter connecting a plurality of input waveform signals; bandwidth determining means for determining a filtering bandwidth in accordance with upper limit frequencies of spectra of a pair of adjacent waveform signals in the synthesized waveform signal; and filtering means for filtering a connection portion of the pair of waveform signals of the synthesized waveform signal by using the determined filtering bandwidth.

The connection portion of the pair of waveform signals connected by the signal connection apparatus is filtered by the bandwidth determined from the spectrum of high frequency components of an input waveform signal. It is therefore possible to reduce noises to be caused by higher harmonics components from the synthesized waveform signal. With the signal connecting apparatus, the end portion of an input waveform signal is not cut so that natural synthesized voices can be reproduced from an input waveform signal of voice waveforms. The bandwidth determining means may include means for Fourier-transforming each of the pair of waveform signals, and the upper limit frequencies of the pair of waveform signals are identified in accordance with a result of Fourier transform. Alternatively, the bandwidth determining means may include high-pass filters for filtering high frequency signals of each of the pair of waveform signals, and the upper limit frequencies of the pair of waveform signals are identified in accordance with average amplitude levels of outputs of the high-path filters. More preferably, the bandwidth determining means includes table storing means for storing a table storing the upper limit frequency of each of spectra of a plurality of candidates for the input waveform signals, acquires identification data for identifying the pair of waveform signals, reads the upper limit frequencies of the spectra of the pair of waveform signals identified by the acquired identification data, and identifies the higher value in the read upper limit frequencies as the upper limit frequency signals of the pair of waveform signals.

DETAILED DESCRIPTION OF THE PREFERRED EMBODIMENTS

With reference to the accompanying drawings, embodiments of the invention will be described by taking as an example a voice synthesizing apparatus.

Figure 1:
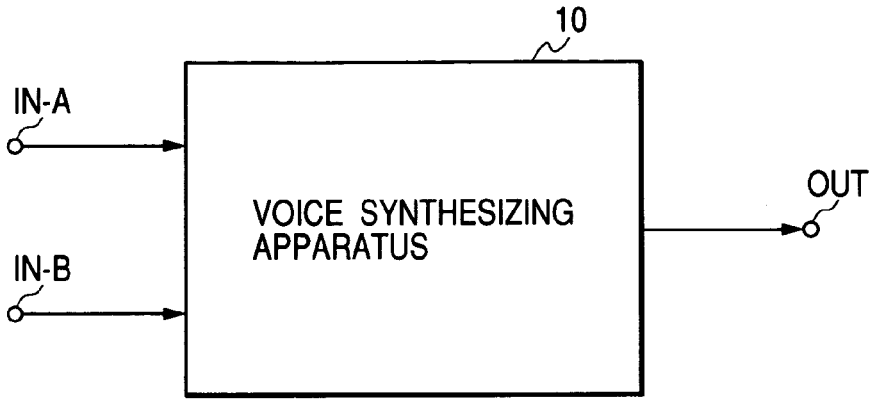
FIG. 1 is a diagram showing a voice synthesizing apparatus according to an embodiment of the invention.

As shown in FIG. 1, a voice synthesizing apparatus 10 according to an embodiment of the invention has the fundamental structure that waveform signals obtained by finely dividing recorded voices at the level of vowel and consonant are supplied to input terminal IN-A and IN-B and a synthesized voice signal of the supplied waveform signals is output from an output terminal OUT.

Figure 2:
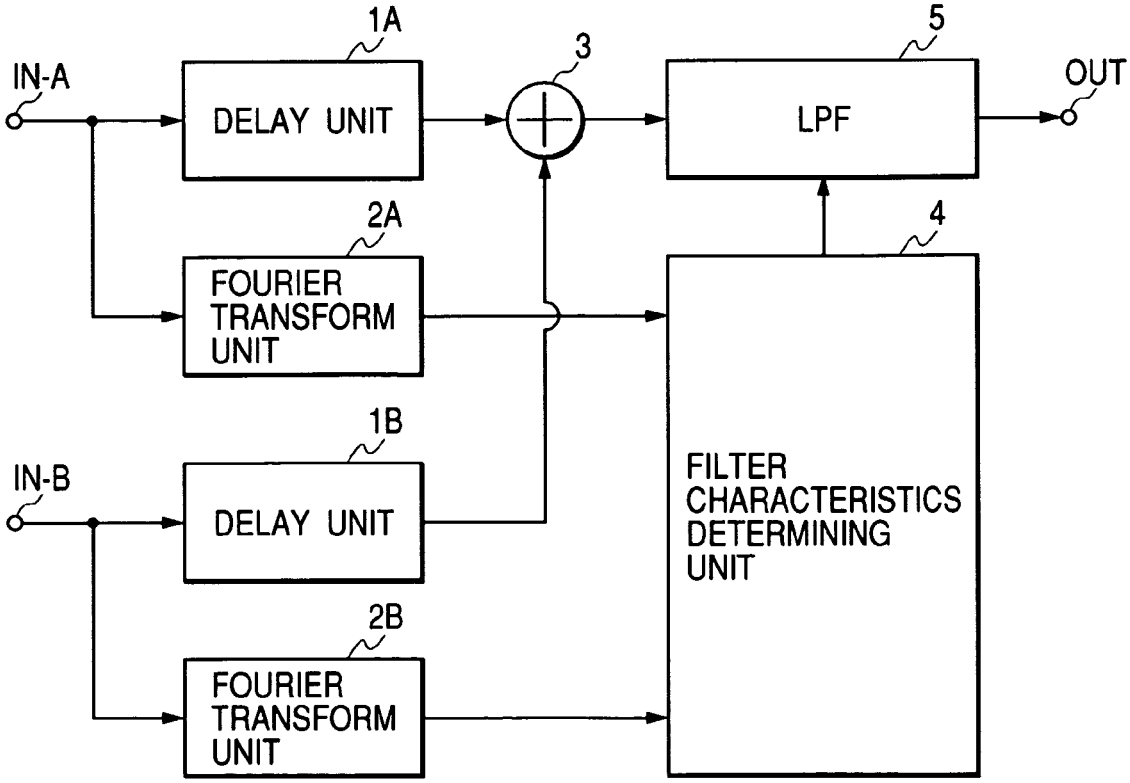
FIG. 2 is a block diagram showing the internal structure of the voice synthesizing apparatus of the embodiment.

The specific internal structure of the voice synthesizing apparatus 10 is shown in FIG. 2. As shown, the voice synthesizing apparatus 10 has: a delay unit 1A and a Fourier transform unit 2A connected to the input terminal IN-A; a delay unit 1B and a Fourier transform unit 2B connected to the input terminal IN-B; an adder 3; a filter characteristics determining unit 4; and a low-pass filter 5 (hereinafter abbreviated to LPF).

The delay units 1A and 1B have substantially the same structure and each is constituted of a delay circuit such as a shift register and the like. The delay unit 1A is connected to the input terminal IN-A, whereas the delay unit 1B is connected to the input terminal IN-B.

When a signal is supplied to the input terminal IN-A, the delay unit 1A delays this signal by a predetermined time and supplies it to the adder 3. When a signal is supplied to the input terminal IN-B, the delay unit 1B delays this signal by a predetermined time and supplies it to the adder 3.

The delay time of the signal supplied to each of the delay units 1A and 1B is substantially the same. This delay time is selected so that the timing when the filter characteristics determining unit 4 supplies a control signal to be described later to LPF 5 satisfies the conditions to be described later.

The Fourier transform units 2A and 2B have substantially the same structure and each is constituted of a Digital Signal Processor (DSP), a Central Processing Unit (CPU) and the like. The Fourier transform unit 2A is connected to the input terminal IN-A, whereas the Fourier transform unit 2B is connected to the input terminal IN-B. Therefore, the Fourier transform unit 2A and delay unit 1A are supplied with the same signal from the input terminal IN-A substantially at the same time, and the Fourier transform unit 2B and delay unit 1B are supplied with the same signal from the input terminal IN-B substantially at the same time.

When a waveform signal is supplied to the input terminal IN-A, the Fourier transform unit 2A creates spectrum data representative of the waveform of a waveform signal through fast Fourier transform (or another arbitrary method which can create data corresponding to the results of Fourier transform of a waveform signal), and supplies the spectrum data to the filter characteristics determining unit 4. Similarly, the Fourier transform unit 2B performs substantially the same operation as that of the Fourier transform unit 2A, and when a waveform signal is supplied to the input terminal IN-B, creates spectrum data representative of the waveform of a waveform signal and supplies the spectrum data to the filter characteristics determining unit 4.

The adder 3 is constituted of an adder circuit and the like. The adder 3 creates a signal representative of a sum of the value of a signal supplied from the delay unit 1A and the value of a signal supplied from the delay unit 1B and supplies the sum signal to LPF 5.

The filter characteristics determining unit 4 is constituted of DSP and CPU. When spectrum data is supplied from the Fourier transform units 2A and 2B, the filter characteristics determining unit 4 determines the cut-off frequency of LPF 5 (specifically, the frequency at which the gain of LPF 5 lowers by 3 dB on the high frequency side from the peak) in accordance with the supplied spectrum data, and creates a control signal representative of the determined cut-off frequency to supply it to LPF 5.

Figures 3A, 3B, 3C:
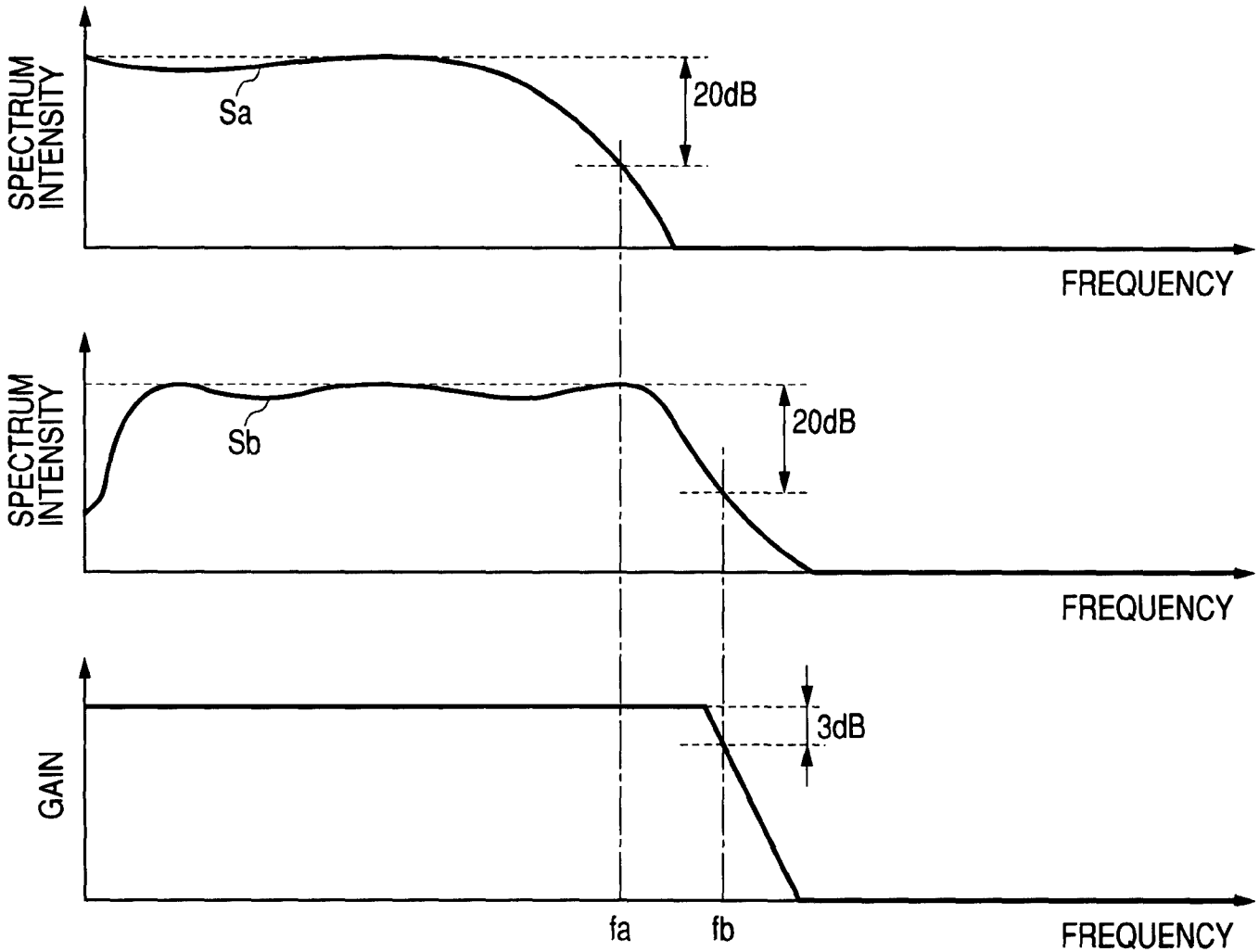
FIG. 3(*a*) is a graph showing a spectrum of a signal supplied to an input terminal IN-A, FIG. 3(*b*) is a graph showing a spectrum of a signal supplied to an input terminal IN-B, and FIG. 3(*c*) is a graph showing the frequency characteristics of a low-pass filter.

More specifically, as shown in FIG. 3(*a*), the filter characteristics determining unit 4 identifies an upper limit frequency fa of the spectrum Sa representative of the spectrum data supplied from the Fourier transform unit 2A, the intensity of the spectrum Sa attenuating by 20 dB on the high frequency side from the peak. As shown in FIG. 3(*b*), the filter characteristics determining unit 4 identifies an upper limit frequency fb of the spectrum Sb representative of the spectrum data supplied from the Fourier transform unit 2B, the intensity of the spectrum Sb attenuating by 20 dB on the high frequency side from the peak. The higher frequency in the identified two frequencies fa and fb is determined as the cut-off frequency of LPF 5. FIG. 3(*c*) is a graph showing the frequency characteristics of LPF 5 in the case of fa<fb (frequency characteristics while the control signal is supplied to LPF 5).

LPF 5 is constituted of, for example, a digital filter of a Finite Impulse Response (FIR) type and the like. LPF 5 filters the signal supplied from the adder 3 and outputs it, in accordance with the presence/absence of the control signal from the filter characteristics determining unit 4 and the frequency indicated by the control signal.

More specifically, while the control signal is supplied from the filter characteristics determining unit 4, LPF 5 creates a signal representative of signal components of the signal supplied from the adder 3 and passed through, for example, a 512-order low-pass filter having the cut-off frequency indicated by the control signal, and outputs the created signal from the output terminal OUT as a signal representative of the filtering results.

While the control signal is not supplied, LPF 5 outputs from the output terminal OUT the signal itself supplied from the adder 3 without substantially filtering it.

Figures 4A, 4B, 4C, 4D:
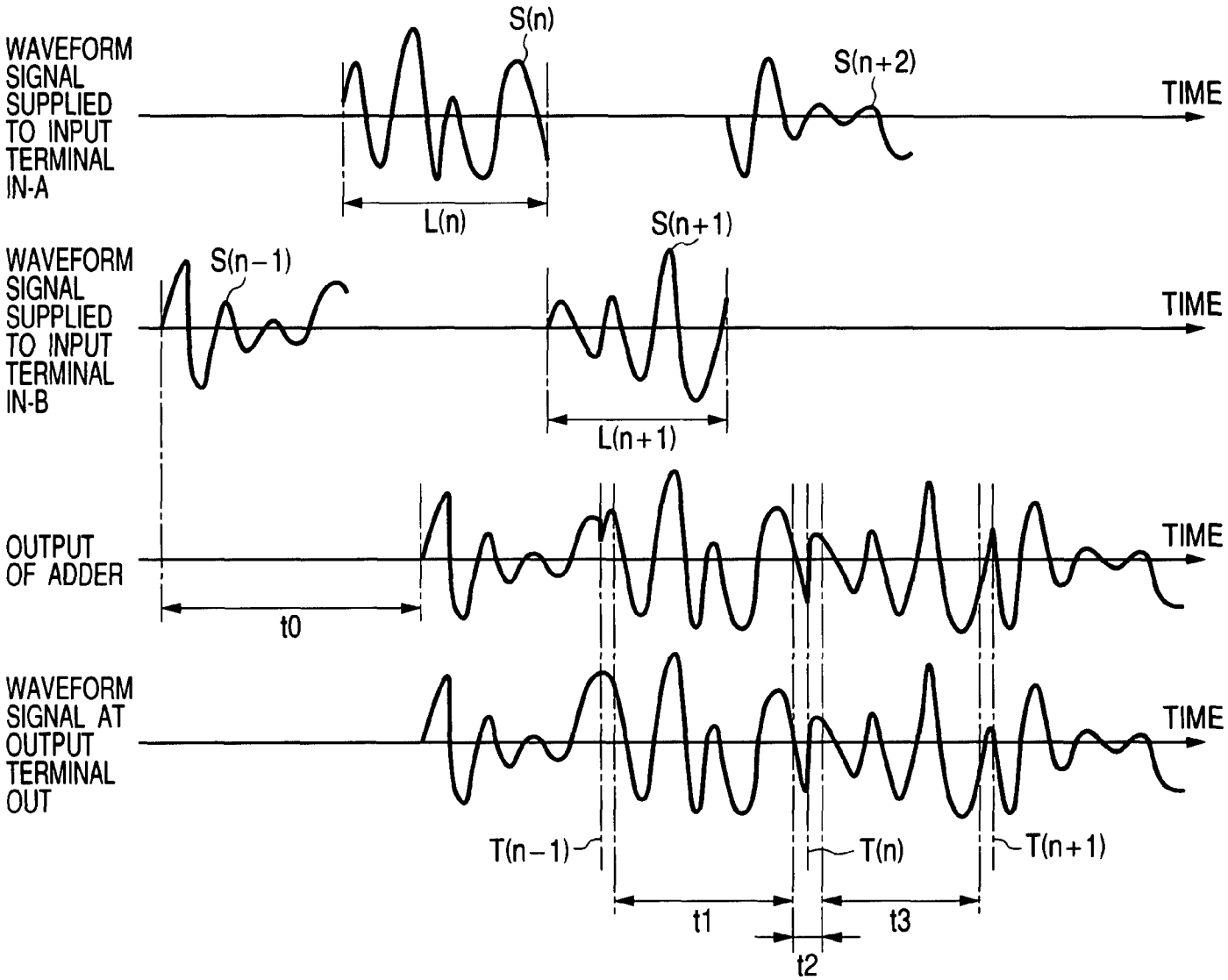
FIG. 4(*a*) is a graph showing a waveform signal supplied to the input terminal IN-A, FIG. 4(*b*) is a graph showing a waveform signal supplied to the input terminal IN-B, FIG. 4(*c*) is a graph showing a signal output from an adder, and FIG. 4(*d*) is a graph showing a signal output from the low-pass filter.

In order to make the voice synthesizing apparatus perform voice synthesis, waveform signals are alternately supplied to the input terminals IN-A and IN-B. For example, as shown in FIGS. 4(*a*) and 4(*b*), waveform signals are sequentially supplied in the manner that assuming that an n-th waveform signal s(n) (n is an arbitrary positive odd number) is supplied to the input terminal IN-A, an (n+1)-th waveform signal s(n+1) starts being supplied to the input terminal IN-B substantially at the same time when the trailing edge of the n-the waveform signal appears.

As the n-th waveform signal is supplied to the input terminal IN-A and the (n+1)-th waveform signal is supplied to the input terminal IN-B, the n-th waveform signal is delayed by the delay unit 1A and the (n+1)-th signal is delayed by the delay unit 1B. The delayed signals are supplied to the adder 3. The delay time (indicated by "t0" in FIG. 4(*c*)) of a wave signal by the delay units 1A and 1B is substantially the same. Therefore, the n-th waveform signal and (n+1)-th waveform signal become continuous substantially without any gap therebetween and are supplied to LPF 5 as shown in FIG. 4(*c*).

The n-th waveform signal is also supplied to the Fourier transform unit 2A, and the (n+1)-th waveform signal is also supplied to the Fourier transform unit 2B. The Fourier transform unit 2A creates spectrum data representative of the waveform of the n-th waveform signal, and the Fourier transform unit 2B creates spectrum data representative of the waveform of the (n+1)-th waveform signal. The spectrum data is supplied to the filter characteristics determining unit 4.

When a paired set of the spectrum data representative of the spectra of the n-th and (n+1)-th waveform signals is supplied, the filter characteristics determining unit 4 identifies the frequencies at which the intensity of each spectrum indicated by the paired set of the spectrum data attenuates by 20 dB on the high frequency side from a peak value. The higher frequency in the identified two frequencies is determined as the cut-off frequency of LPF 5, and the control signal representative of the determined cut-off frequency is supplied to LPF 5.

As shown in the timing chart of FIG. 4(*d*), the cut-off frequency determined from the n-th and (n+1)-th waveform signals is supplied from the filter characteristics determining unit 4 to LPF 5 during the period including the timing (indicated at "T(n)" in FIG. 4(*d*)) when a signal output from the adder 3 is switched from the n-th waveform signal to the (n+1)-th waveform signal. In order to make it easy to understand, in the specification and the drawing, it is assumed that the delay time of signal transmission in LPF 5 itself is as short as negligible.

In order to prevent deterioration of voices represented by the voice signal output from the voice synthesizing apparatus, it is desired that the time duration from the supply start of the control signal to the switching timing of the waveform signal is set to one tenth or shorter of the time duration of the n-th waveform signal (indicated at "L(n)" in FIG. 4(*a*)). Similarly, it is desired that the time duration from the switching timing of the waveform signal to the supply end of the control signal is set to one tenth or shorter of the time duration of the (n+1)-th waveform signal (indicated at "L(n+1)" in FIG. 4(*b*)).

LPF 5 outputs the following signals.

(A) During the period (indicated at "t1" in FIG. 4(*d*)) after the supply end of the control signal representative of the cut-off frequency determined from the (n−1)-th and n-th waveform signals and before the supply start of the control signal representative of the cut-off frequency determined from the n-th and (n+1)-th waveform signals, the n-th waveform signal is output from the output terminal OUT without substantially filtering it.

(B) During the period (indicated at "t2" in FIG. 4(*d*)) while the control signal representative of the frequency determined from the n-th and (n+1)-th waveform signals is supplied, a signal representative of signal components passed through the 512-order low-pass filter having this cut-off frequency is output from the output terminal OUT.

(C) During the period (indicated at "t3" in FIG. 4(*d*)) after the supply end of the control signal representative of the cut-off frequency determined from the n-th and (n+1)-th waveform signals and before the supply start of the control signal representative of the cut-off frequency determined from the (n+1) -th and (n+2)-th waveform signals, the (n+1)- th waveform signal is output from the output terminal OUT without substantially filtering it.

Since LPF 5 performs filtering in the manner described above, the n-th and (n+1)-th waveform signals can be connected together without creating higher harmonics components and without substantially losing the frequency components essentially contained in each waveform signal. Therefore, voices represented by the connected waveform signals have smaller noises and natural synthesized voices are spoken.

The structure of the voice synthesizing apparatus is not limited only to that described above.

The number of filter orders of LPF 5 is arbitrary. The definition of the upper limit frequency of the spectrum represented by the spectrum data supplied from the Fourier transform units 2A and 2B and the definition of the cut-off frequency of LPF 5 are not limited only to the definitions of the embodiment, but they are arbitrary.

A single DSP and a single CPU may realize the whole or part of the functions of the delay units 1A and 1B, Fourier transform units 2A and 2B, adder 3, filter characteristics determining unit 4 and LPF 5.

Instead of the input terminals IN-A and IN-B, the voice synthesizing apparatus may have a recording medium drive (e.g., flexible disk drive, Magneto-Optical (MO) disk or the like) for reading waveform signals from a recording medium (e.g., flexible disk, MO drive or the like) storing the waveform signals and supplying the read waveform signals to the delay units 1A and 1B and Fourier transform units 2A and 2B.

Instead of the output terminal OUT, the voice synthesizing apparatus may have a recording medium drive for writing signals passed through LPF 5 into a recording medium.

The single recording medium drive may provide both the function of reading waveform signals from a recording medium and the function of writing signals passed through LPF 5 into the recording medium.

A waveform signal supplied to the input terminal IN-A or IN-B may be a signal representative of an unpronounced sound. In this case, a waveform signal in a pronounced state and a waveform signal in an unpronounced state are connected together. It is possible to prevent the generation of noises from a portion including an edge of the waveform signal in the pronounced state (specifically the start or end of a voice or a breathing portion), and this portion can be listen as a natural voice.

The voice synthesizing apparatus of the invention does not necessarily require the Fourier transform units 2A and 2B. Instead, a table may be used which stores a correspondence between identification data for identifying a candidate for a waveform signal to be supplied to the input terminals IN-A and IN-B and frequency data indicating an upper limit frequency of a spectrum of the candidate.

With this approach, identification data for identifying the waveform signal supplied to the input terminals IN-A and IN-B are acquired from an external, and the frequency data corresponding to the acquired identification data is read from the table and supplied to the filter characteristics determining unit 4. The filter characteristics determining unit 4 determines the higher frequency represented in the frequency data as the cut-off frequency of LPF 5.

Figure 5:
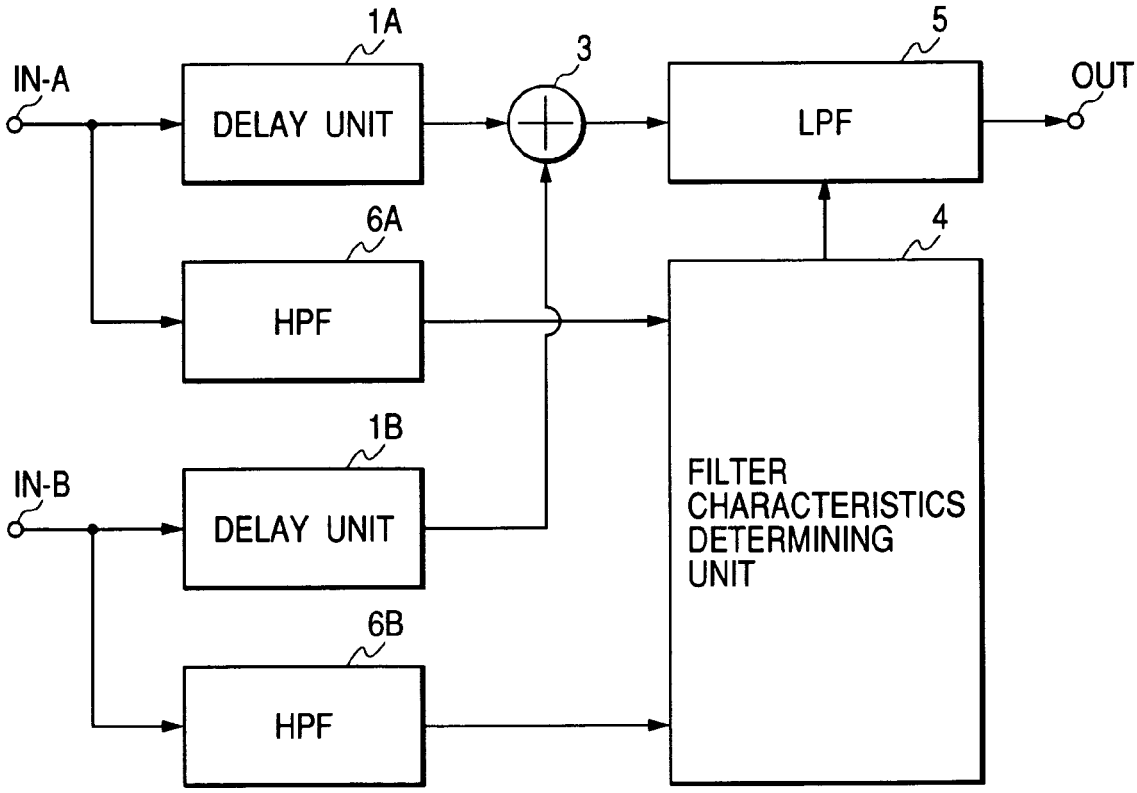
FIG. 5 is a block diagram showing the internal structure of a voice synthesizing apparatus according to a modification of the first embodiment shown in FIG. 2.
Figure 6A:
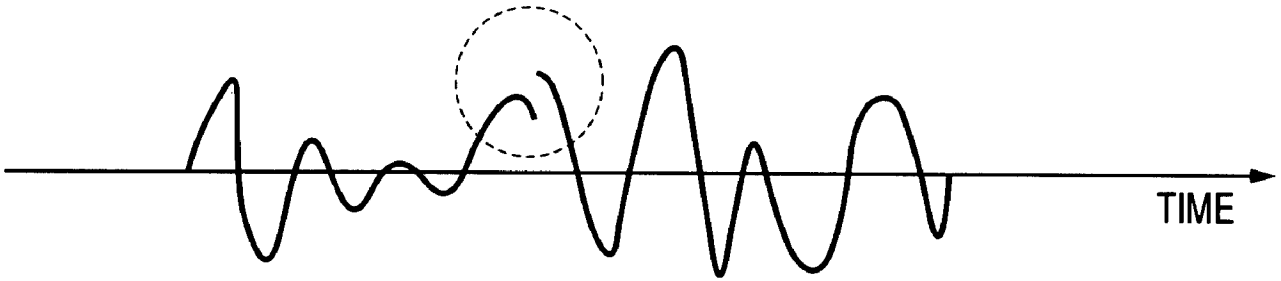
FIG. 6(*a*) is a diagram showing a discontinuous portion between two waveform signals to be connected, FIG. 6(*b*) is a diagram illustrating a conventional method of replacing a discontinuous portion with a straight line, and FIG. 6(*c*) is a diagram showing waveform signals connected by the MDS method.
Figure 6B:
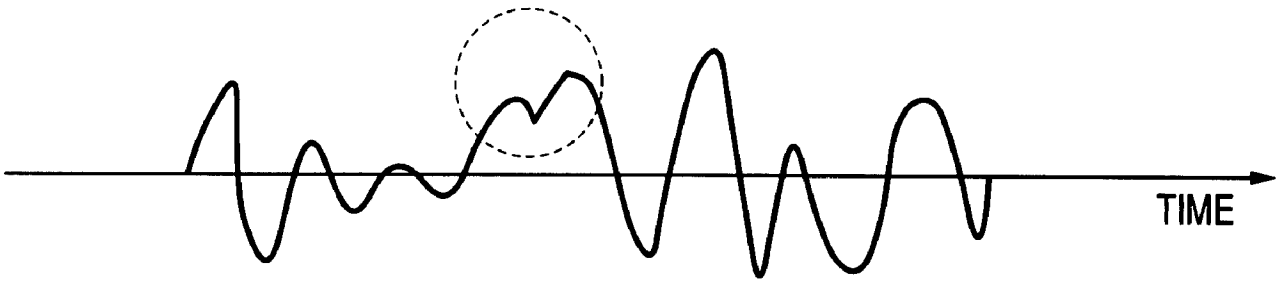
Figure 6C:
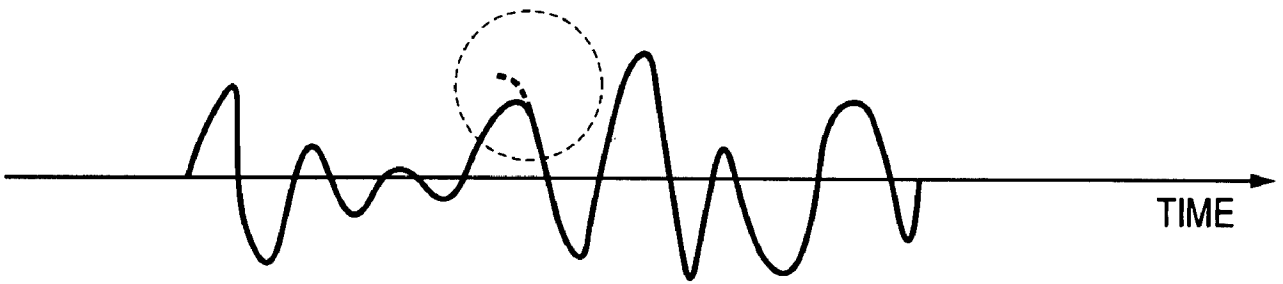

As shown in FIG. 5, the voice synthesizing apparatus may have high-pass filters (HPF) 6A and 6B in place of the Fourier transform units 2A and 2B.

HPFs 6A and 6B have substantially the same structure and each is constituted of, for example, a digital filter of the Infinite Impulse Response (IIR) type and the like.

HPF 6A is connected to the input terminal IN-A and the HPF 6B is connected to the input terminal IN-B. The same signal is supplied from the input terminal IN-A to HPF 6A and delay unit 1A substantially at the same time, and the same signal is supplied from the input terminal IN-B to HPF 6B and delay unit 1B substantially at the same time.

As a waveform signal is supplied from the input terminal IN-A, HPF 6A substantially cuts off the signal components of the waveform signal equal to or lower than a predetermined cut-off frequency, and supplies the other signal components to the filter characteristics determining unit 4. As a waveform signal is supplied from the input terminal IN-B, HPF 6B substantially cuts off the signal components of the waveform signal equal to or lower than a predetermined cut-off frequency, and supplies the other signal components to the filter characteristics determining unit 4. It is assumed that the cut-off frequencies of HPFs 6A and 6B are substantially equal.

In the voice synthesizing apparatus having HPFs 6A and 6B in place of the Fourier transform units 2A and 2B, in accordance with the signal components of the waveform signals supplied from HPFs 6A and 6B, the filter characteristics determining unit 4 determines the cut-off frequency of LPF 5. More specifically, it determines the cut-off frequency in accordance with a larger value of either an average amplitude level of the signal components supplied from HPF 6A or an average amplitude level of the signal components supplied from HPF 6B.

The voice synthesizing apparatus having HPFs 6A and 6B in place of the Fourier transform units 2A and 2B can omit a complicated Fourier transform process so that the voice synthesizing apparatus can perform signal processing at faster speed.

The embodiment of the invention has been described above. The signal connection apparatus of the invention may be realized by a general computer system without using a dedicated system.

For example, a program for performing the operations of the delay unit 1A (or HPF 6A), delay unit 1B (or HPF 6B), Fourier transform units 2A and 2B, adder 3, filter characteristics determining unit 4 and LPF 5 is stored in a recording medium (CD-ROM, MO, flexible disk or the like). The program read from the recording medium is installed in a personal computer to realize the voice synthesizing apparatus for executing the above-described processes.

For example, the program may be written in a Bulletin Board System (BBS) on a communication network to distribute the program via the network. A carrier may be modulated by a signal representative of the program, and an apparatus received the modulated carrier demodulates it to recover the program.

The processes of the voice synthesizing apparatus can be performed by running the program under the control of an OS similar to other application programs.

If OS shares a portion of the processes or if OS constitutes a portion of constituent elements of the invention, a program excluding such a portion may be stored in a recording medium. Also in this case, according to the invention, the recording medium stores the program for realizing each function or step provided by a computer.

According to the invention, since the above-described arrangement is adopted, higher harmonics to be created by discontinuous connection portions of voice waveform signals can be removed efficiently. It is therefore possible to considerably reduce noises in synthesized voice signals and very natural synthesized voices can be created.

What is claimed is:

1. A signal connecting apparatus for interconnecting a plurality of voice waveform elements to create a synthesized voice signal, the plurality of waveform elements being created and stocked beforehand, the apparatus comprising:

connecting means for inputting a plurality of input signals each representing a voice waveform element and for interconnecting the input signals to create an output signal;

means for executing Fourier transforms on two adjacent input signals within the output signal and determining an upper limit frequency for each of the two adjacent input signals on the basis of the result of the Fourier transforms; and filter means for filtering the connection portion of the two input signals interconnected by the connecting means to smooth a waveform signal of the connection portion, wherein said filtering is performed by using a low pass filter with a dynamic cutoff frequency set to the highest of the two upper limit frequencies;

wherein for the connection portion of the two input signals which is to be filtered, a time length from a head of the connection portion to a border of the two input signals is one tenth or less of a time length of preceding one of the two input signals, and a time length from the border to an end of the connection portion is one tenth or less of a time length of succeeding one of the two input signals.

2. A method for interconnecting a plurality of voice waveform elements to create a synthesized voice signal, the plurality of waveform elements being created and stocked beforehand, the method comprising the steps of:

inputting and interconnecting a plurality of input signals each representing a voice waveform element to create an output signal;

executing Fourier transforms on two adjacent input signals within the output signal and determining an upper limit frequency for each of the two adjacent input signals on the basis of the result of the Fourier transforms; and filtering the connection portion of the two input signals obtained in the inputting and interconnecting step to smooth a waveform signal of the connection portion, wherein said filtering is performed by using a low pass filter with a dynamic cutoff frequency set to the highest of the two upper limit frequencies;

wherein for the connection portion of the two input signals which is to be filtered, a time length from a head of the connection portion to a border of the two input signals is one tenth or less of a time length of preceding one of the two input signals, and a time length from the border to an end of the connection portion is one tenth or less of a time length of succeeding one of the two input signals.

* * * * *